US006655046B2

(12) United States Patent
Schäfer et al.

(10) Patent No.: US 6,655,046 B2
(45) Date of Patent: Dec. 2, 2003

(54) DEVICE AND PROCESS FOR UNIFORM DRYING OF PRODUCTS IN WEB FORM PRODUCED BY COATING

(75) Inventors: Wolfgang Schäfer, St. Augustin (DE); Peter Schwarz, Königswinter (DE); Rudi Brathuhn, Neuwied (DE); Michael Hoffmann, Neuwied (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 34 days.

(21) Appl. No.: 09/952,705

(22) Filed: Sep. 14, 2001

(65) Prior Publication Data

US 2002/0058109 A1 May 16, 2002

Related U.S. Application Data

(60) Provisional application No. 60/233,450, filed on Sep. 18, 2000.

(30) Foreign Application Priority Data

Nov. 23, 2000 (DE) ..... 100 58 253

(51) Int. Cl.[7] ..... F26B 3/00

(52) U.S. Cl. ..... 34/446; 34/451; 34/557; 427/372.2; 427/379

(58) Field of Search ..... 34/446, 451, 557, 34/636, 638; 118/719, 58, 62, 64, 66; 427/352, 372.2, 377, 379, 384

(56) References Cited

U.S. PATENT DOCUMENTS

| | | | | | |
|---|---|---|---|---|---|
| 3,599,554 | A | * | 8/1971 | Aelterman et al. | 430/30 |
| 4,590,685 | A | * | 5/1986 | Roth | 34/268 |
| 5,377,428 | A | * | 1/1995 | Clark | 34/446 |
| 5,470,436 | A | * | 11/1995 | Wagle | 162/207 |
| 5,771,603 | A | * | 6/1998 | Kotitschke et al. | 34/446 |
| 6,311,410 | B1 | * | 11/2001 | Heikkila et al. | 34/444 |

* cited by examiner

*Primary Examiner*—Henry Bennett
*Assistant Examiner*—Kathryn S. O'Malley
(74) *Attorney, Agent, or Firm*—D. Peter Hochberg; Sean Mellino; Katherine R. Vieyra

(57) ABSTRACT

A device and a process for drying thin layers or films which are manufactured by applying a coating mass, which is produced on an aqueous basis, to a support, the said layer or film being transported through a drying device having at least one drying zone, is characterized in that in at least one drying zone, designated as moisture-compensation zone, air is supplied which has a moisture content corresponding to the constant moisture content of the film to be prepared or the layer to be prepared.

15 Claims, 2 Drawing Sheets

Figure 1:
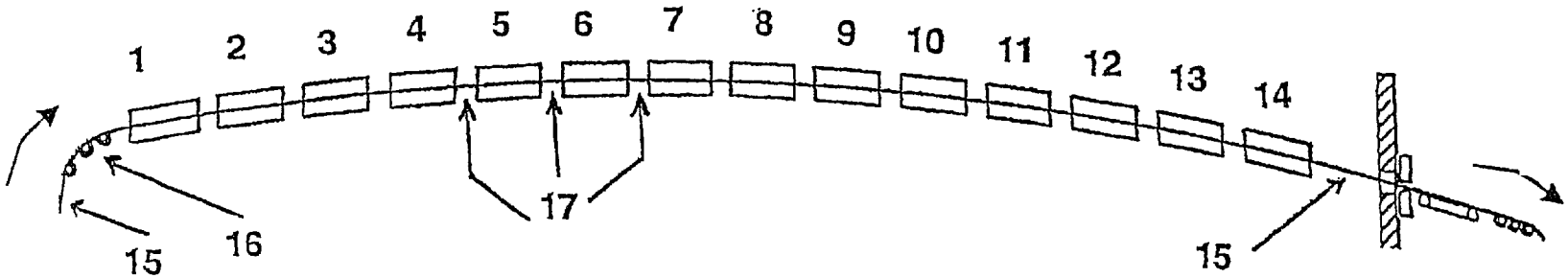

DEVICE AND PROCESS FOR UNIFORM DRYING OF PRODUCTS IN WEB FORM PRODUCED BY COATING

CROSS-REFERENCE TO RELATED AMENDMENT

This application claims the benefit of U.S. Provisional Application No. 60/233,450, filed on Sep. 18, 2000.

The invention relates to a device and a process for the uniform drying of products in web form which have been obtained by coating, and, in particular, of thin films which essentially comprise organic raw materials and are manufactured on an aqueous basis.

The films or coatings to which this invention relates are based on organic raw materials or on mixtures of such substances. These are preferably water-soluble substances. Such organic raw materials include polymers such as polyvinyl alcohol, polyvinyl pyrrolidone, cellulose derivatives, polyvinyl acetate, polyethylene glycol, alginates, carrageenan, xanthan, gelatin and other water-soluble polymers known to the skilled artisan, and also mixtures and copolymers of these substances. If desired, such films or coatings may also include fillers such as mannitol, lactose, calcium phosphate, glucose, sorbitol, etc., active substances such as drugs, aroma substances, menthol, etc., sweeteners such as cyclamate, flavours such as glutamate, and other ingredients, including in some cases volatile ingredients. These films may also have mucoadhesive properties.

For various application purposes, films are required which are very thin, i.e. having a thickness of between 10 and 500 $\mu$m, preferably between 50 and 200 $\mu$m. A problematic characteristic of such thin films is their high sensitivity to atmospheric humidity. At high atmospheric humidity, swelling may be observed in these films, which can cause an increase in volume and possibly the sticking together of two or more overlying films. Conversely, such films tend to become brittle and to fracture if atmospheric humidity is too low.

This behaviour can lead to problems, in particular with respect to the manufacture of such films. In manufacturing the films, typically, a procedure is used wherein a coating mass or composition is applied as an aqueous solution or dispersion to a web-shaped sheet material or paper which serves as carrier or support, and is subsequently subjected to drying. In the process, the coated support material is continuously passed through a drying oven. The zone dryers used for this purpose are typically provided with incoming-air nozzles which distribute the air over the entire width of the product web, i.e. transversely to the running direction of the product web. This leads to the edge regions having more contact with the moving air than the regions in the centre of the product web (cf. FIG. 2).

Especially in the case of films or other coatings which are manufactured on an aqueous basis, this may result in overdrying in the edge region of the coated product web (relative to the running direction of the product web). If the drying conditions are chosen such that the region located in the centre (in longitudinal, that is, running direction) of the coated support web has been dried to a desired degree, in most cases the edge region is at the same time excessively dried (overdried). In the case of product webs which are processed with nonaqueous solvents, this effect is of no significance since the general aim is to expel all solvent residues from the product, i.e. the solvents are removed to a level of greater than or equal to 99%. There is therefore no "overdrying" at the edges.

The above-described overdrying of aqueous materials in the edge regions of the coated web-shaped support (=product web) may lead to shrinkage of the material at the edges of the product web and possibly even to detachment of the coating mass or of the dried thin film from the support since the extent of the shrinkage of the support and of the coating composition (or of the dried film) may be different.

The construction of the zone drier with the incoming air nozzles transverse to the running direction of the product web leads to a non-uniform drying and thereby to differences in the curing or cross-linking of the polymer chains in the case of films or other coatings produced on the basis of organic materials. During the further processing of the web material, this in turn leads to different chemical or physical behaviour of the coated product, depending on whether it has been cut from the centre or from the edge region of the product web.

It was thus the object of the present invention to provide processes and devices enabling the production of films or coatings of the kind mentioned whose moisture content, both in transverse and in longitudinal direction, is equal over the entire product web, and which avoid the disadvantages described. More particularly, the object is to enable the production of thin films of consistent quality, especially in terms of their moisture content.

Surprisingly, this object is achieved by a process for drying thin films or coatings by applying a coating mass, which is produced on an aqueous basis, to a support, the layer or film being transported through a drying device which has at least one drying zone, characterized in that in at least one drying zone, designated as moisture-compensation zone, air is supplied which has a moisture content corresponding to the constant moisture content of the film to be prepared or the layer to be prepared, by a process for manufacturing by applying a coating mass prepared on an aqueous basis and containing an organic substance to a support, transferring the composite of support and coating mass thus obtained into a drying device having at least one drying zone, and subsequent drying of the film, during which process the said film, located on the support, is conveyed through the drying device, characterized in that during the drying, in at least one drying zone, designated moisture-compensation zone, air is supplied having a moisture content which corresponds to the constant moisture content of the film to be prepared, as well as by a device for setting a constant moisture content of a coating mass applied to a web-shaped support, said device having a drying zone with a fresh air feed and a waste air return, characterized in that the fresh air feed is provided with a device enabling or capable of adjusting the moisture content of the air to a constant value, and a drying device comprising a plurality of drying zones arranged in tandem, through which the web-shaped support is transported, characterized by at least three zones arranged in tandem, namely at least one preheat zone, at least one drying zone and, at least one drying or designated moisture-compensation zone, wherein the fresh air feed is provided with a device enabling or capable of adjusting the moisture content of the air to a constant value, as well as by the embodiments of the invention described below.

In the inventive process for drying thin layers or films, the layer or film is, preferably continuously, passed through a drying device with at least one drying zone; in the process, in at least one drying zone, air is supplied which has a moisture content corresponding to the constant moisture content of the film to be prepared or the layer to be prepared. Such a drying zone is called moisture compensation zone.

In this manner, when passing through such a zone, the more strongly dried edge regions of the coated carrier web are moistened (or remoistened) and thus brought to the moisture content corresponding to the desired product moisture). The moisture content of the centre zone of the coated film web is not increased in the process. In this way it is accomplished that in the edge regions of the product web, the same moisture content occurs as in the centre zone of the product web. The film or coating thereby possesses uniform product properties over its entire surface. Detachment of the film or coating from the support web in the edge regions can thus be prevented.

"Constant moisture content" is understood to mean the desired moisture content of the product (film, coating) in its final condition after manufacture (predetermined moisture: 50–70% relative humidity, preferably 70%).

The manufacture of thin films or coatings is accomplished according to the present invention in that initially a coating mass is prepared which contains organic substances which are suitable for forming a film or a coating, for instance, polymers such as polyvinyl alcohol, polyvinyl pyrrolidone, cellulose derivatives, polyvinyl acetate, polyethylene glycol, alginate, carrageenan, xanthan, gelatine and other water-soluble polymers known to the skilled artisan, and also mixtures of copolymers of these substances. Preferably, these substances are completely or partially dissolved or dispersed in water. Apart from water, other solvents may be used as well, e.g. alcohols such as methanol, ethanol, propanol, or solvent mixtures, e.g. water-alcohol mixtures.

The coating composition may further comprise various additives, e.g. fillers such as mannitol, lactose, calcium phosphate, glucose, sorbitol, etc., and/or active substances such as drugs, aroma substances, menthol, etc., and/or sweeteners such as cyclamate, flavours such as glutamate, and/or other ingredients, including in some cases volatile ingredients.

The coating mass thus obtained is subsequently applied to a web-shaped support material, using the casting method or the reverse coating method. As support material, a web or sheet of paper, plastic, metal, or a composite of two or more of these materials may be used. Also, a web-shaped support material may be used which has depressions for accommodating the coating material (so-called thermoformed blister sheets).

The product web may, for example, have a width of about 0.1 m to about 2 m; preference is given to widths of 0.50 to 1.6 m. The films or coatings applied to the support layer are preferably thin, that is, their thickness amounts to 10–500 $\mu$m, preferably 50–200 $\mu$m.

The coated support material, i.e. the composite of support and coating composition, is thereafter transferred into a drying device (drying oven) and transported through the same, preferably continuously.

The drying device comprises at least one drying zone, but better at least two of such zones, through which the coated film passes during the drying process.

The process according to the present invention for manufacturing thin films or coatings is characterized in that during the drying, air is supplied in at least one drying zone, designated moisture compensation zone, which air possesses a moisture content corresponding to the constant moisture content of the film to the prepared.

In the processes of the present invention for drying thin films or coatings, the drying is preferably accomplished in that in a first phase of the drying, at least one surface region of the coating mass applied to the carrier acquires a moisture content corresponding to the constant moisture content of the film to be prepared (predetermined moisture content), and at least one further surface region of the coating mass acquires a moisture content which is below the constant moisture content of the film to be prepared; the latter surface region is thus more strongly dried than corresponds to the predetermined moisture content.

In a subsequent phase of the drying it is accomplished that the at least one surface region of the coating composition applied to the support which has a moisture content below the constant moisture content of the film to be prepared acquires a moisture content which corresponds to the constant moisture content of the film to be prepared. This is accomplished, as described above, by means of one or more moisture compensation zones.

A preferred embodiment of the drying process thus provides for the coating composition or film applied to the support to be passed through at least two drying zones arranged in tandem, preferably by continuous feed transport.

In this process, the film or layer initially passes through at least one drying zone wherein the film is dried to such a degree that its moisture content is reduced to a level where it corresponds to at least the constant moisture content of the film in its manufacturing state. After this stage of the drying, partial regions of the film, i.e. at least one surface region, especially the edge regions, may possess a still lower moisture content. This means that especially in the edge region, relative to the longitudinal or transport direction of the coated web, overdrying may occur.

Thereafter, the coated carrier is conveyed through at least one moisture compensation zone wherein the film is charged with air having a moisture content corresponding to the constant moisture content of the film in its state of manufacture. In this way, it is achieved that the overdried edge regions of the coated product web are remoistened, the moisture content in the process being adjusted to the predetermined value of the product. The coated product web, that is the film or layer, thereby acquires a predeterminable moisture which is uniform over its entire surface, without individual regions becoming overdried or having too much moisture.

A further embodiment of the drying process provides for the film or coated support to be initially passed through a preheating zone prior to the start of the actual drying process, in which zone its temperature is raised to a level above room temperature, i.e. above 25° C., and preferably in the range of 30–50° C. Following this preheat zone, the support provided with the coating mass reaches the drying zones, as described above.

Especially preferred is an embodiment of the drying process according to which the film or coated support is conveyed successively through a preheat zone and subsequently through at least 3, preferably 4 to 16, drying zones. The total number of the drying zones essentially depends on the drying profile which is intended in each given case. At least one, but more preferably at least two of the drying zones, are configured as moisture-compensation zones. The moisture-compensation zones are preferably located between the drying zones.

Furthermore, it is advantageous to adjust the air supply and/or the temperature and/or the moisture content of the fresh air in the individual zones (preheating zones, drying zones, moisture-compensation zones) by means of open-loop or closed-loop control devices such that a drying profile is obtained that is adapted to the respective film or coating product.

The invention further comprises a device for setting a constant moisture content of a coating mass applied to a support having the form of a web. This device, which is a moisture-compensation zone, has a drying zone with a fresh-air feed and a waste-air return, the said fresh-air feed being provided with a device which enables the adjustment of or is capable of adjusting the moisture content of the air to a constant value. Adjusting the moisture content of the fresh air supply can also be performed automatically by a control loop.

The effect of the aforementioned device is due to the film or coating to be dried being conveyed through the said zone, during which process the said film or coating is charged with air which is of defined temperature and has a defined moisture content. To this end, the interior space of the said device is provided with at least two air nozzles, preferably slit nozzles, via which the incoming fresh air, which has been adjusted to a particular moisture content, is emitted to at least two spatial regions of the drying zone through which the coated product web is being transported.

The drying device according to the present invention for uniformly drying a film or coating applied to a web-shaped support comprises at least three drying zones arranged in a row, through which the web-shaped support to be dried is conveyed further. The aforementioned at least three zones are at least one preheat zone, at least one drying zone, and at least one drying zone, designated moisture-compensation zone, in which the fresh-air feed is provided with a device which enables or is capable of adjusting the moisture content of the air to a constant value. It is possible to provide two or more of each of the aforementioned zones in the drying device. Thus, the drying device may comprise 3 to 30, preferably 4 to 16 zones, depending on the desired drying profile or on the product properties.

For example, FIG. 1 shows a drying device with 14 zones (1)–(14). Here, zones (1)–(3), for example, may serve as preheat zones and zones (4)–(14) as drying or moisture-compensation zones.

In order to be able to adapt the drying conditions to individual requirements, it is advantageous if the drying device, or at least one of the zones of the drying device, is provided with devices enabling the open-loop or closed-loop control of the air feed rate and/or temperature and/or moisture content parameters.

The processes and devices according to the invention enable the manufacture of thin films or coatings of the kind mentioned herein which are characterized by their consistent quality and by a moisture content which is constant over their entire surface. Furthermore, the disadvantage of the coating becoming detached from the support web during the drying process is avoided.

In the following, the invention will be explained by means of FIGS. 1 and 2. The embodiments shown merely represent examples and do not in any way restrict the invention.

FIG. 1 shows, in diagrammatic representation, a side view of a drying device according to the invention. The device has 14 zones (1)–(14), arranged in tandem, through which the product web (=coated support web; 15) is passed. The arrows indicate the direction of transport; (16) designates the transport rollers.

The individual zones (1)–(14) are arranged in tandem, preferably at small distances from each other, so that only narrow channels (17) are located between them. In this way it is achieved that the desired temperature and moisture profiles are maintained with as much precision as possible.

The freshly coated support web (15) is fed into the drying device at zone (1) and leaves the same at zone (14), in a uniformly dried condition.

Figure 2:
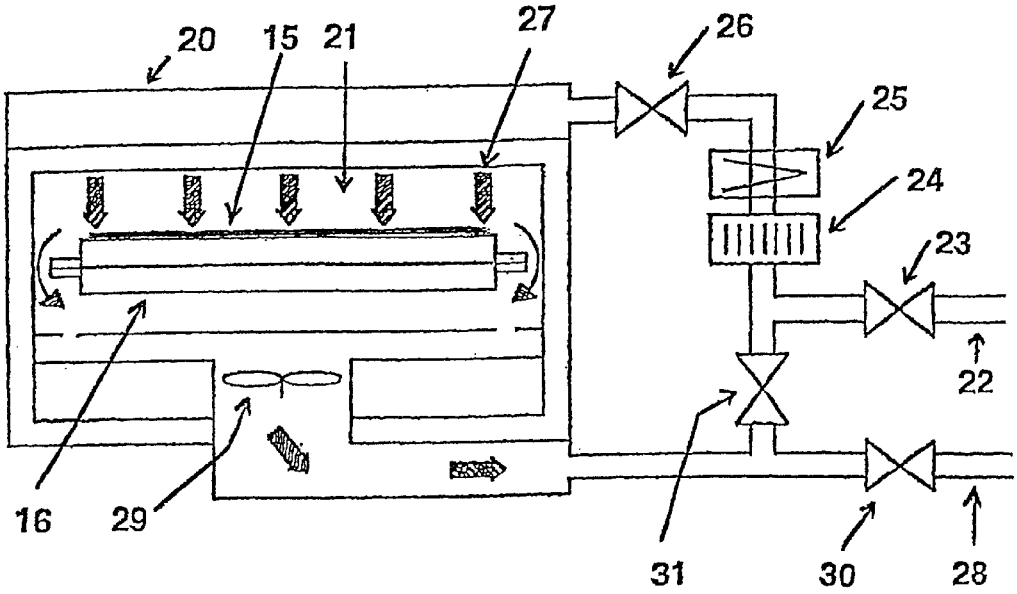

Zones (1)–(14) may be preheating or drying zones, with at least one drying zone being configured as a moisture-compensation zone (see FIG. 2). For example, zones (1) to (3) may be provided as preheating zones, zones (4) to (9) as drying zones and zones (10) to (14) as moisture-compensation zones.

The temperature profile in zones 1 to 14 may preferably be configured as follows:

| Zone No. | Temp. |
|---|---|
| 1 | 30–50° C. |
| 2 | 30–60° C. |
| 3 | 50–70° C. |
| 4 | 50–80° C. |
| 5 | 60–80° C. |
| 6 | 70–80° C. |
| 7 | 65–75° C. |
| 8 | 60–70° C. |
| 9 | 60–70° C. |
| 10 | 50–70° C. |
| 11 | 50–65° C. |
| 12 | 45–60° C. |
| 13 | 45–55° C. |
| 14 | 35–50° C. |

FIG. 2 shows, in schematic representation, a section (transverse to the direction of transport) through a device according to the present invention for adjusting a constant moisture content (moisture-compensation zone; 20). The coated support web (product web; 15) is conveyed through the interior space of the device. Via a feed conduit (22) and a control device (23; e.g. a control valve), the incoming air is passed via an air moistener (24), a heating worm (25), and optionally via a further control valve (26), by means of slit nozzles (27) into the inner space (21) of the moisture-compensation zone (20). The fresh air emitted from the nozzles, which has been enriched with moisture, passes over the product web (15) in the direction of the arrows and past the lateral edges of the web (thin arrows). Then, the waste air is removed from the moisture-compensation zone in the direction of the lower arrows, via the air return (28), aided by a ventilating fan (29). The air return (28) may likewise be provided with a control valve (30). Furthermore, the waste air may optionally be returned to the cycle by way of a control valve (31), and mixed with the fresh air which enters via (22). By means of the air moistener (24) it is possible to adjust the moisture content of the air to a constant value.

Those drying zones of the drying device which are not configured as moisture-compensation zones are of a construction similar to that in FIG. 2, with the difference that no air moistener (24) is provided.

What is claimed is:

1. Process for drying thin layers or films which are manufactured by applying a coating mass, which is produced on an aqueous basis, to a support, said layer or film being transported through a drying device which has at least one drying zone, wherein in at least one drying zone, designated as a moisture-compensation zone, air is supplied which has a moisture content corresponding to the constant moisture content of the film to be prepared or the layer to be prepared.

2. Process according to claim 1, wherein the drying is performed in such a maimer that in a first phase of the drying, at least one surface region of the coating mass applied to the support acquires a moisture content corresponding to the constant moisture content of the film to be prepared, and at least one further surface region of the coating mass acquires a moisture content below the constant moisture content of the film to be prepared, and in a subsequent phase of the drying, the at least one surface region of the coating mass applied to the support having a moisture content below the constant moisture content of the film to be prepared, acquires a moisture content corresponding to the constant moisture content of the film to be prepared.

3. Process according to claim 1, wherein the coating mass, located on the support, or the film, respectively, is conveyed through at least two drying zones which are arranged in tandem, the said film or layer a) passing initially through at least one drying zone wherein the film is dried to such an extent that its moisture content is reduced to a level where it corresponds to at least the constant moisture content of the film in its manufacturing state, it being possible that partial regions of the film, especially the edge regions, possess an even lower moisture content, and b) being subsequently passed through at least one further drying zone, designated moisture-compensation zone, wherein the film is charged with air which possesses a moisture content that corresponds to the constant moisture content of the film in its manufacturing state.

4. Process according to claim 3, wherein the film or the coated support, respectively, is initially conveyed through a preheat zone, wherein its temperature is increased to a value above room temperature, and subsequently undergoes the drying steps a) and b).

5. Process according to claim 1, wherein the film or the coated support, respectively, is continuously conveyed through a preheat zone and subsequently through at least 3 zones, of which at least one is configured as a moisture-compensation zone.

6. Process according to claim 5, having at least 4 to 16 drying zones.

7. Process according to claim 1, wherein the film or the coated support, respectively, is conveyed through two or more moisture-compensation zones during drying.

8. Process according to claim 1, wherein in the individual zones, the air supply and/or the temperature and/or moisture content in the fresh air is/are adjusted by means of open-loop or closed-loop control devices such that a drying profile adapted to the respective film or coating product is produced.

9. Process for manufacturing thin films or coatings by applying a coating mass prepared on an aqueous basis and containing an organic substance to a support, transferring the composite of support and coating mass thus obtained into a drying device having at least one drying zone, and subsequent drying of the film, during which process the said film, located on the support, is conveyed through the drying device, wherein during the drying, in at least one drying zone, designated as a moisture-compensation zone air is supplied having a moisture content which corresponds to the constant moisture content of the film to be prepared.

10. Process according to claim 9, wherein the drying is performed in such a manner that in a first phase of the drying, at least one surface region of the coating mass applied to the support acquires a moisture content corresponding to the constant moisture content of the film to be prepared, and at least one further surface region of the coating mass acquires a moisture content below the constant moisture content of the film to be prepared, and in a subsequent phase of the drying, the at least one surface region of the coating mass applied to the support having a moisture content below the constant moisture content of the film to be prepared, acquires a moisture content corresponding to the constant moisture content of the film to be prepared.

11. Process according to claim 9, wherein the coating mass, located on the support, or the film, respectively, is conveyed through at least two drying zones which are arranged in tandem, the said film or layer a) passing initially through at least one drying zone wherein the film is dried to such an extent that its moisture content is reduced to a level where it corresponds to at least the constant moisture content of the film in its manufacturing state, it being possible that partial regions of the film, especially the edge regions, possess an even lower moisture content, and b) being subsequently passed through at least one further drying zone, designated moisture-compensation zone, wherein the film is charged with air which possesses a moisture content that corresponds to the constant moisture content of the film in its manufacturing state.

12. Drying device for uniformly drying a film or a coating applied to a web-shaped support, comprising a plurality of drying zones arranged in tandem, through which the web-shaped support is transported, characterized by at least three zones arranged in tandem, namely at least one preheat zone;

at least three drying zones; and at least one drying zone designated as a moisture-compensation zone, wherein the fresh air feed contains a device enabling or capable of adjusting moisture content of the air to a constant value, and wherein said moisture-compensation zone(s) is/are located between said drying zones.

13. Drying device according to claim 12, wherein two or more preheat zones and/or drying zones and/or moisture-compensation zones are present.

14. Drying device according to claim 12, comprising 3 to 30 zones.

15. Drying device according to claim 9, comprising 4 to 16 zones.

* * * * *